US007866792B2

(12) United States Patent
Umeda

(10) Patent No.: US 7,866,792 B2
(45) Date of Patent: Jan. 11, 2011

(54) INK JET PRINTER

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 830 days.

(21) Appl. No.: 11/824,119

(22) Filed: Jun. 29, 2007

(65) Prior Publication Data

US 2008/0007589 A1 Jan. 10, 2008

(30) Foreign Application Priority Data

Jun. 30, 2006 (JP) ..... 2006-181780

(51) Int. Cl.
*B41J 2/155* (2006.01)

(52) U.S. Cl. ..... 347/42

(58) Field of Classification Search ..... 347/20, 347/37, 40–42

See application file for complete search history.

(56) References Cited

U.S. PATENT DOCUMENTS 6,749,279 B2 6/2004 Kobayashi et al.

FOREIGN PATENT DOCUMENTS

JP 6-15826 1/1994

*Primary Examiner*—An H Do

(74) *Attorney, Agent, or Firm*—Frommer Lawrence & Haug LLP

(57) ABSTRACT

An ink jet printer with a transportation device which transports a print medium along a first direction, first and second ink jet heads, and a head moving device. The first ink jet head has a first nozzle line with a plurality of nozzles aligned along a direction intersecting with the first direction. The second ink jet head has a second nozzle line with a plurality of nozzles aligned along a direction intersecting with the first direction. The head moving device moves the first ink jet head with respect to the second ink jet head along a direction intersecting with the first direction, between a first positional relationship, where the first and second nozzle lines overlap each other along a second direction perpendicular to the first direction, and a second positional relationship, where the first nozzle line and the second nozzle line do not overlap each other along the second direction.

14 Claims, 7 Drawing Sheets

INK JET PRINTER

CROSS-REFERENCE TO RELATED APPLICATION

The present application claims priority based on Japanese Patent Application 2006-181780 filed on Jun. 30, 2006, the contents of which are hereby incorporated by reference within this application.

BACKGROUND OF THE INVENTION

Field of the Invention

The present invention relates to an ink jet printer that discharges ink from an ink jet head to print an image on a print medium transported within a predetermined plane. Particularly, the present invention relates to an ink jet printer having a line-type ink jet head in which nozzles are aligned in a direction intersecting with a print medium transporting direction within the predetermined plane.

In a line-type ink jet printer, the resolution of a printed image is determined by the pitch of the nozzles of the ink jet head. The resolution can be increased by narrowing the pitch of the nozzles. However, if the pitch of the nozzles is narrowed, both the productivity and yield of the ink jet head deteriorate. Thus, the amount by which resolution is increased by narrowing the pitches is limited.

U.S. Pat. No. 6,749,279, for example, discloses an ink jet head that is tilted with respect to an axis that is perpendicular to a printing surface of a print medium as a center(see, for example, FIG. 4 of that document). In this case, the space between adjacent two nozzles along the widthwise direction of the print medium can be reduced. Accordingly, the print resolution can be increased.

Also, Japanese Application Publication No. 6-15826, for example, discloses the following serial printer. In this serial printer, two ink jet heads are mounted in the carriage. The nozzle surface of one of the ink jet heads is tilted along the print medium transporting direction (see, for example, FIG. 7 of that document). In this case, a space between the ink droplets discharged by one of the ink jet heads can be filled with an ink droplet discharged by the other ink jet head. Accordingly, the resolution can be doubled.

SUMMARY OF THE INVENTION

As described above, various technologies for realizing higher resolutions have been developed. On the other hand, the inventor of the present invention wishes to reduce the length of the line-type ink jet head (the length of the widthwise direction of a print medium) as much as possible. This is because as the length of the ink jet head increases, the yield of the ink jet head deteriorates. However, if the length of the ink jet head is reduced, printing on a wide print medium cannot be performed.

The present specification provides a technology capable of realizing both high resolution printing and printing on a wide print medium by using a short ink jet head.

The inventor of the present invention focuses on the high resolution that is required for a relatively small print medium (e.g., a photo and a postcard), and the low resolution high-speed printing that is required for a relatively large print medium. The technology disclosed by the present specification was invented with such printing requirements in mind.

An ink jet printer disclosed by the present specification has a transportation device, a first ink jet head, a second ink jet head, and a head moving device. The transportation device transports a print medium along a first direction within a predetermined plane. The first ink jet head has a first nozzle line. The first nozzle line has a plurality of nozzles for discharging ink. The nozzles of the first nozzle line are aligned along a direction intersecting with the first direction within the predetermined plane. The second ink jet head has a second nozzle line. The second nozzle line has a plurality of nozzles for discharging ink. The nozzles of the second nozzle line are aligned along a direction intersecting with the first direction within the predetermined plane. The head moving device moves the first ink jet head with respect to the second ink jet head along a direction intersecting with the first direction within the predetermined plane, between a first positional relationship and a second positional relationship. In the first positional relationship, the first nozzle line and the second nozzle line overlap each other along a second direction perpendicular to the first direction within the predetermined plane, and each of the nozzles of the first nozzle line and of the second nozzle line are mutually offset along the second direction. In the second positional relationship, the first nozzle line and the second nozzle line do not overlap each other along the second direction, in contrast to the first positional relationship.

When the first ink jet head and the second ink jet head are in the first positional relationship, the first nozzle line and the second nozzle line overlap each other along the second direction (however, the nozzles of the first nozzle line and the nozzles of the second nozzle line are mutually offset along the second direction). In the area where the first nozzle line and the second nozzle line overlap each other, the space between the ink droplets discharged from the nozzles of one of the nozzle lines can be filled by an ink droplet discharged from a nozzle of the other nozzle line. As a result, high-resolution printing can be realized.

When the first ink jet head and the second ink jet head are in the second positional relationship, the area in which the two nozzle lines overlap each other along the second direction is smaller than that in the first positional relationship. Specifically, the combined length of the two nozzle lines along the second direction is longer than that in the first positional relationship. Therefore, printing can be performed on a wide print medium.

Even when using two relatively short ink jet heads, high-resolution printing can be performed on a relatively small print medium by disposing these ink jet heads in the first positional relationship. On the other hand, printing can be performed on a relatively large print medium by disposing the two ink jet heads in the second positional relationship. According to this technology, higher resolutions can be realized, and printing can be performed on a wide print medium by using short ink jet heads.

It should be noted that in the second positional relationship the first nozzle line and the second nozzle line may overlap each other along the second direction, or may not overlap. In the first case, in the area where these nozzle lines overlap with each other, each nozzle of both the first nozzle line and the second nozzle line may or may not be mutually offset along the second direction.

DETAILED DESCRIPTION OF THE INVENTION

First Embodiment

Figure 1:
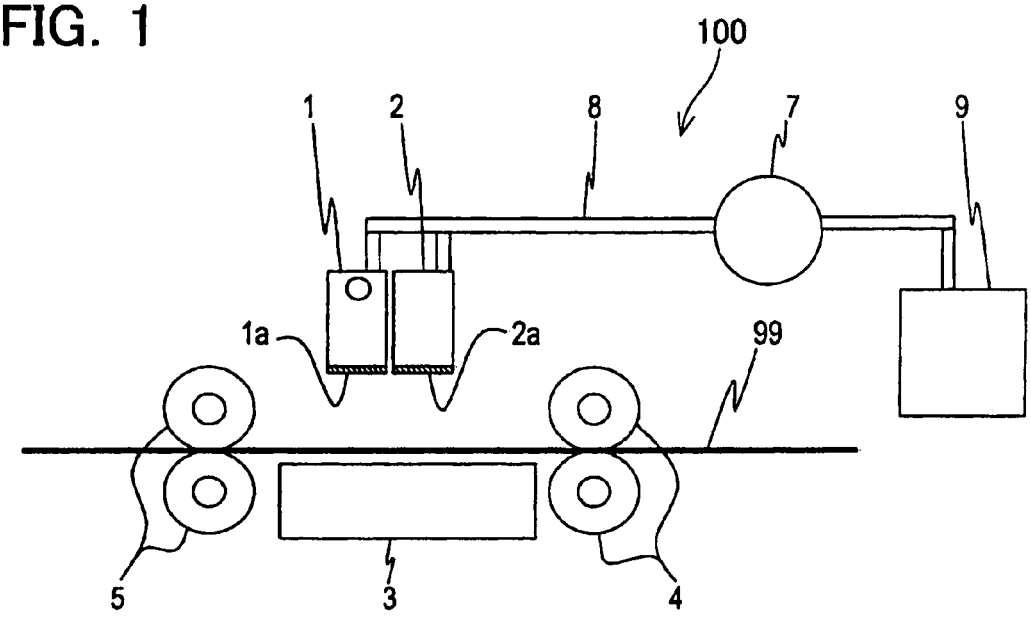
FIG. 1 schematically shows the configuration of an ink jet printer.

FIG. 1 schematically shows the configuration of an ink jet printer 100 of the present embodiment. The ink jet printer 100 has two ink jet heads 1, 2 having substantially the same configuration as each other. A platen 3 for supporting paper 99 in a planar fashion is provided on the lower side of the ink jet heads 1, 2. A lower surface of the ink jet head 1 is provided with a nozzle plate 1*a*. The nozzle plate 1*a* has a plurality of nozzles 10 for discharging ink (see FIG. 2A and FIG. 2B). A lower surface of the ink jet head 2 is provided with a nozzle plate 2*a*. As with the nozzle plate 1*a*, the nozzle plate 2*a* has a plurality of nozzles 10 for discharging ink. It should be noted that paper 99 is used as a print medium in the present embodiment. However, any type of print medium may be used as long as an image, characters or the like can be printed or recorded by means of the ink jet heads. For example, a plate-like member, a cloth, a resin sheet, an optical recording disk or the like may be used.

The printer 100 further has a pair of transportation rollers 4 and a pair of paper discharging rollers 5. The pair of transportation rollers 4 is disposed on the upstream side of the platen 3 in a paper-transporting direction. The transportation rollers 4 hold the paper 99 therebetween and feed it onto the platen 3. The pair of paper discharging rollers 5 is disposed on the downstream side of the platen 3 in the paper-transporting direction. The paper discharging rollers 5 sandwich the paper 99 fed onto the platen 3 and discharge the paper 99. It should be noted that the upper roller of the pair of paper discharging rollers 5 (the roller abutting against the top surface of the paper 99 (the surface on which an image is printed as described hereinafter)) is a spur roller that has a small contact area with the paper 99.

A pump 7 supplies ink from an ink cartridge 9 via a tube 8 to each of the ink jet heads 1, 2. Although FIG. 1 only shows the structure for supplying one color of ink, the ink jet printer 100 has a structure for supplying four colors of ink. In the ink jet printer 100, the pump 7, tube 8 and ink cartridge 9 are provided for each of the colors: magenta, cyan, yellow and black. The ink jet printer 100 can print a color image on the paper 99. The pump 7 and the ink cartridge 9 are shared by each of the ink jet heads 1, 2.

Next, a nozzle pattern formed in the ink jet head 1 is described. In the present embodiment, the nozzle pattern of the ink jet head 1 is identical to a nozzle pattern of the ink jet head 2. Hereinafter, the nozzle pattern of the ink jet head 1 is mainly described.

Figure 2A:
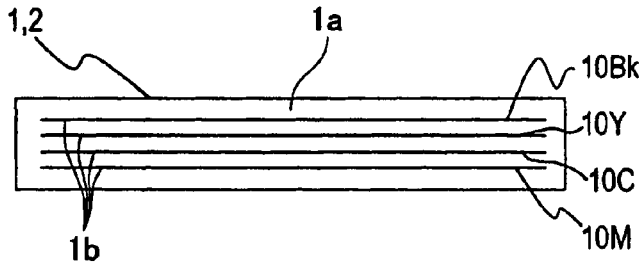
FIG. 2A shows a lower surface of an ink jet head.

As shown in FIG. 2A, the ink jet head 1 has a long configuration along the horizontal direction. Four nozzle lines 1*b* (called "first nozzle lines 1*b*" hereinafter) are formed on the lower surface of the ink jet head 1. Each of the first nozzle lines 1*b* extends along a longitudinal direction of the ink jet head 1. The four first nozzle lines 1*b* are aligned parallel to one another. Each of the first nozzle lines 1*b* corresponds to a different color, respectively. Each of the first nozzle lines 1*b* has the plurality of nozzles 10 for discharging the corresponding ink. For example, the first nozzle line 1*b* for discharging black ink has a plurality of nozzles 10Bk for discharging black ink. Moreover, the other first nozzle lines 1*b* also respectively have nozzles 10M, 10C and 10Y for discharging the corresponding ink (magenta, cyan and yellow). As with the ink jet head 1, four nozzle lines 2*b* (called "second nozzle lines 2*b*" hereinafter) are formed on the lower surface of the ink jet head 2 (see FIG. 3A).

Figure 2B:
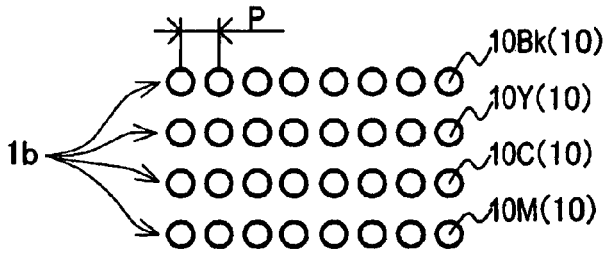
FIG. 2B shows nozzle lines formed in the lower surface of the ink jet head.

As shown in FIG. 2B, in each of the first nozzle lines 1*b*, the plurality of nozzles 10 are aligned with equal spaces therebetween (space P) in the longitudinal direction of the ink jet head 1. In the explanation hereinafter, suffixes of M (magenta), C (cyan), Y (yellow), and Bk (black) are attached to the respective nozzles 10, if it is necessary to distinguish the nozzles 10 based on the ink colors. If it is not necessary to distinguish the nozzles 10 based on their corresponding ink colors, the suffixes are omitted.

Figure 3A:
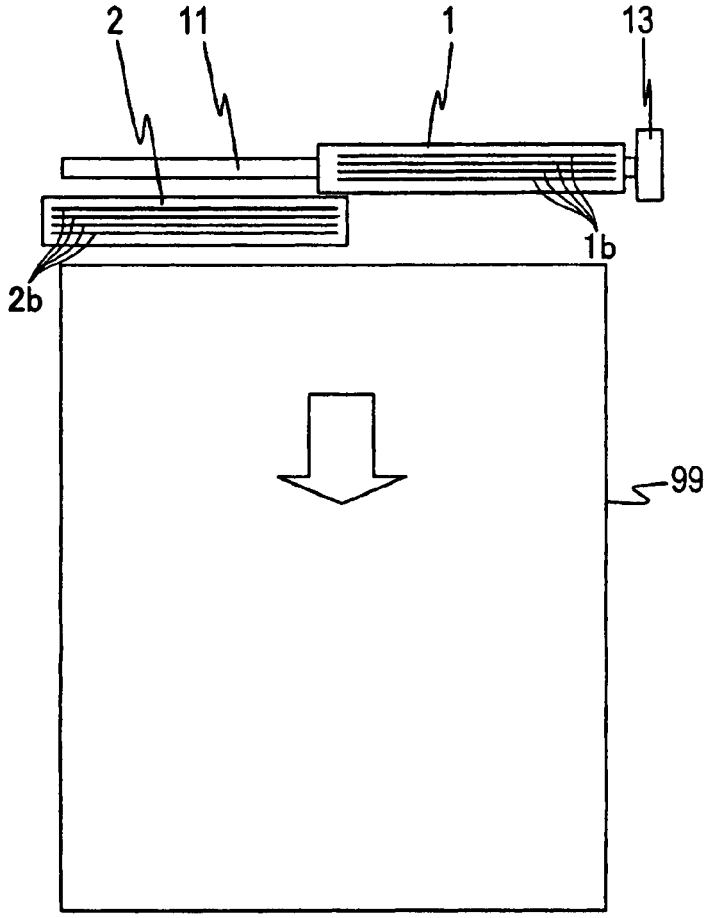
FIG. 3A shows ink jet heads located at a low-quality relationship.

As shown in FIG. 3A, the ink jet heads 1, 2 are aligned along the paper-transporting direction (the direction of the arrow shown in FIG. 3A). Specifically, the ink jet heads 1, 2 are offset along the paper-transporting direction. The ink jet heads 1, 2 are adjacent to each other along the paper-transporting direction. Furthermore, the ink jet head 1 and the ink jet head 2 are disposed at the same height. Specifically, the distance between the ink jet head 1 and the paper 99 is equal to the distance between the ink jet head 2 and the paper 99. Moreover, the longitudinal direction (the horizontal direction in FIG. 3A) of the ink jet head 1 is identical to the direction perpendicular to the paper-transporting direction. The longitudinal direction (the horizontal direction in FIG. 3A; referred to as "widthwise direction" hereinafter) of the ink jet head 2 is identical to the direction perpendicular to the paper-transporting direction. The longitudinal direction of the ink jet head 1 and the longitudinal direction of the ink jet head 2 are identical to each other.

A screw shaft 11 is engaged with the ink jet head 1 along the longitudinal direction. The chassis of the ink jet printer 100 (not shown) is provided with a head moving motor 13 that rotates the screw shaft 11 to move the ink jet head 1. The ink jet head 1 can move between a low quality printing position shown in FIG. 3A and a high quality printing position shown in FIG. 4A by means of the rotation of the head moving motor 13. The ink jet head 1 can move in the widthwise direction. Specifically, the ink jet head 1 can move while keeping the longitudinal direction thereof parallel to the longitudinal direction of the ink jet head 2.

Figure 3B:
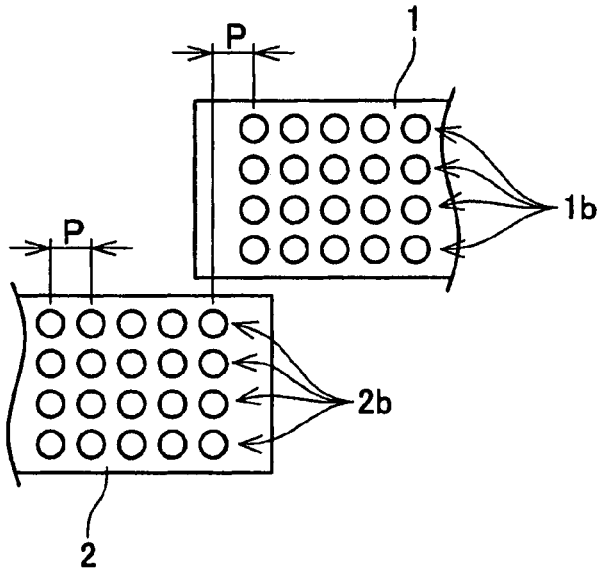
FIG. 3B shows nozzles of the ink jet heads.

As shown in FIG. 3A and FIG. 3B, each of the first nozzle lines 1*b* and each of the second nozzle lines 2*b* do not overlap with each other in the widthwise direction in the low quality printing position. In this state, an image can be formed over the entire width of the paper 99 of a size JIS-A4 (portrait orientation) by the first nozzle lines 1*b* and the second nozzle lines 2*b*. In this state, as shown in FIG. 3B, the nozzles 10 of the ink jet heads 1, 2 are disposed with regular spaces P therebetween as mentioned above, over the entire width.

As described above, in the low quality printing position of the present embodiment, each first nozzle line 1*b* of the ink jet head 1 and each second nozzle line 2*b* of the ink jet head 2 do not overlap with each other in the widthwise direction. However, in the low quality printing position, a part of the first nozzle lines 1*b* in the vicinity of the left end of the ink jet head 1 (an end portion on the left side in FIG. 3A) may overlap with, in the widthwise direction, a part of the second nozzle lines 2*b* in the vicinity of the right end of the ink jet head 2 (an end portion on the right side in FIG. 3A). In this case, each of the nozzles 10 of the first nozzle lines 1*b* and each of the nozzles 10 of the second nozzle lines 2*b* may be at the same positions along the widthwise direction within the overlapping area. Moreover, each of the nozzles 10 of the first nozzle lines 1*b* and each of the nozzles 10 of the second nozzle lines 2*b* may be offset in the widthwise direction in the overlapping area.

Figure 4A:
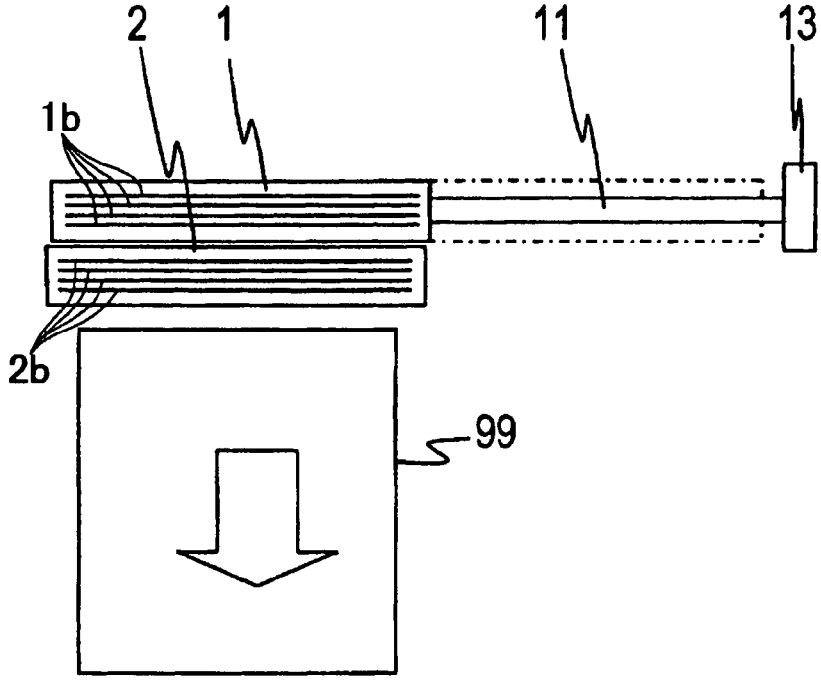
FIG. 4A shows the ink jet heads located at a high-quality relationship.
Figure 4B:
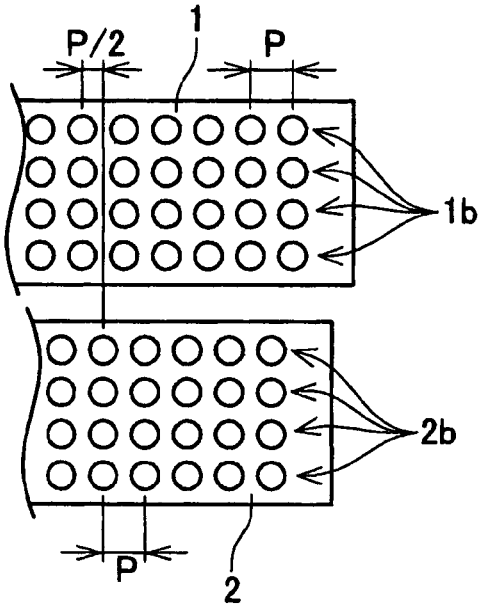
FIG. 4B shows the nozzles of the ink jet heads.

In the high quality printing position shown in FIG. 4A, substantially the entire ink jet head 1 and substantially the entire ink jet head 2 overlap with each other along the widthwise direction. In this case, as shown in FIG. 4B, the ink jet heads 1, 2 overlap each other such that both ink jet heads 1, 2 are offset from each other in the widthwise direction by a distance equal to half the space P. Each of the first nozzle lines 1*b* and each of the second nozzle lines 2*b* overlap each other such that the both nozzle lines are offset from each other in the widthwise direction by P/2. Substantially the entire first nozzle lines 1*b* and substantially the entire second nozzle lines 2*b* overlap along the widthwise direction. In the case in which the paper 99 has the same width as an L-size picture or a postcard, both the first nozzle lines 1*b* and second nozzle lines 2*b* are disposed throughout the entire width of the paper 99. In this case, the nozzles 10 of each first nozzle line 1*b* and the nozzles 10 of each second nozzle line 2*b* are disposed alternately along the widthwise direction. In this case, each space between nozzles 10 is equal to P/2 with respect to the widthwise direction. As a result, high-resolution printing can be performed on relatively small paper 99.

Although not shown in the figure, a pair of guides is provided on a paper tray that stores the paper 99 transferred onto the platen 3 by the transportation rollers 4. A fixed guide is provided at a position corresponding to the left side of the paper tray in FIG. 3A and FIG. 4A. A movable guide is provided at a position corresponding to the right side of the paper tray in FIG. 3A and FIG. 4A. Any paper 99 can be excellently guided to the position shown in FIG. 3A or FIG. 4A.

Figure 5:
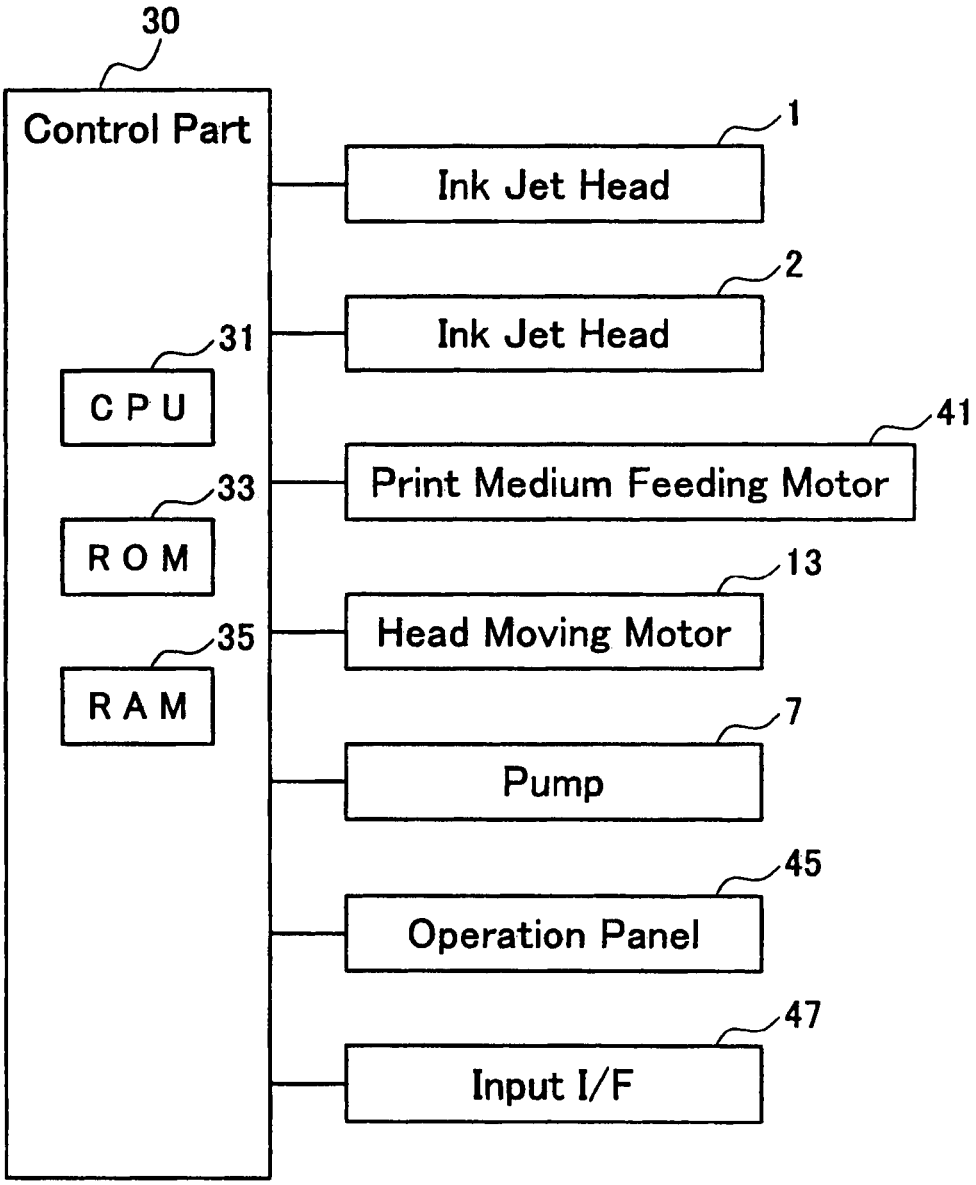
FIG. 5 shows a control block diagram of the ink jet printer.

Next, the configuration of the control system of the ink jet printer 100 is explained. FIG. 5 is a block diagram showing the configuration of the control system of the ink jet printer 100. As shown in FIG. 5, the ink jet printer 100 has a control part 30 for controlling the operation of the entire ink jet printer 100. This control part 30 is constituted as a microcomputer having a CPU 31, a ROM 33 and a RAM 35 as the principal parts. Not only the abovementioned ink jet heads 1, 2, pump 7 and head moving motor 13 are connected to the control part 30, but a print medium feeding motor 41, for driving the transportation rollers 4 and paper discharging rollers 5, is also connected to the control part 30 via a drive circuit, which is not shown. An operation panel 45, which is subjected to various settings by a user, is connected to the control part 30 via an interface, which is not shown. Moreover, an input interface (input I/F) 47 to which various data are input from a personal computer (not shown) is connected to the control part 30, the personal computer being a host device for the ink jet printer.

Once the image data is input to the input interface 47, a control part 30 that has the abovementioned configuration drives the pump 7 and ink jet heads 1, 2 and discharges the ink from each nozzle 10 while transporting the paper 99 by driving the print medium feeding motor 41. Accordingly, an image corresponding to the image data is printed on the paper 99.

Furthermore, in the case in which the input data of the input interface 47 contains data for specifying image quality, or in the case in which desired image quality is specified through the operation panel 45, the control part 30 executes the following operations. Specifically, the control part 30 drives the head moving motor 13 in order to move the ink jet head 1 to the abovementioned high quality printing position or the abovementioned low quality printing position in response to the specified quality. It should be noted that when paper 99 that has the same width as an L-size picture or a postcard is specified as the type of paper, the control part 30 may move the ink jet head 1 to the high quality printing position. When paper 99 that has a wider width is specified, the control part 30 may move the ink jet head 1 to the low quality printing position.

The drive signal to be input to each of the ink jet heads 1, 2 (i.e., a drive signal for a known actuator, which is not shown, is provided so as to correspond to each nozzle 10) may vary depending on whether or not the ink jet head 1 is disposed at the high quality printing position or the low quality printing position.

When the ink jet head 1 is disposed at the high quality printing position, the discharge of the ink droplets from the nozzles 10 may be controlled so as to produce smaller ink droplets than when the ink jet head 1 is disposed at the low quality printing position.

In the ink jet printer 100 of the present embodiment, if the ink jet heads 1, 2 are disposed at the high quality printing position, the first nozzle lines 1*b* of the ink jet head 1 and the second nozzle lines 2*b* of the ink jet head 2 overlap. The nozzles 10 of each of the ink jet heads 1, 2 are disposed alternately in the overlapping area. As a result, the space between the nozzles 10 along the widthwise direction is equal to half the space P between the nozzles 10 in each nozzle line along the widthwise direction. Therefore, if the ink jet heads 1, 2 are disposed at the high quality printing position, the resolution will be twice the resolution obtained when the ink jet heads are disposed at the low quality printing position, whereby a high-quality image can be printed.

For this reason, when each of the ink jet heads 1, 2 corresponds to a resolution of, for example, 600 dpi, an image can be printed at a resolution of 1200 dpi. Although it is possible to technically produce a 1200-dpi class ink jet head, the yield thereof is deteriorated. In the present embodiment, a 1200-dpi image can be printed using ink jet heads 1, 2 with a resolution of 600 dpi, with these ink jet heads being easily produced and having a good yield. As a result, the yield of the ink jet heads can be improved and production costs can be reduced.

In the ink jet printer 100 of the present embodiment, it is not necessary to tilt the ink jet heads in order to perform high-resolution printing, as is the case for the conventional ink jet printer technologies described. For example, in the case of U.S. Pat. No. 6,749,279, the ink jet head needs to be disposed at an inclination angle of 60° in order to double the resolution. In this case, the length of the ink jet head is significantly increased in the paper-transporting direction. The size of the device increases. Moreover, in the case of, for example, Japanese Application Publication No. 6-15826, across tilted ink jet head the height of the nozzles varies. The distance between a nozzle disposed at a high position and the paper increases. When the distance between the nozzle and the paper is large, sometimes printing is not performed well. In the present embodiment, since the ink jet heads 1, 2 do not have to be disposed on a tilt; an image can be stably formed on the paper 99. In the present embodiment, it is preferable not to dispose the ink jet heads on a tilt as an image can be stably formed, however the technology of the present embodiment can be applied to a printer in which an ink jet head is disposed on a tilt.

Moreover, except for the presence of a screw hole with which the screw shaft 11 is engaged, the ink jet heads 1, 2 have the same configuration as each other. Therefore, two acceptable ink jet heads can be selected from a number of ink jet heads already produced. A screw hole may be formed on one of the ink jet heads to obtain the ink jet head 1, and the other ink jet head may be taken as the ink jet head 2. Therefore, in the present embodiment, the yield of the ink jet heads can be improved and production costs can be reduced.

In the ink jet printer 100, if the ink jet heads 1, 2 are disposed in the low quality printing position, each of the first nozzle lines 1*b* and each of the second nozzle lines 2*b* do not overlap each other. Specifically, the nozzles 10 of each first nozzle line 1*b* and the nozzles 10 of each second nozzle line 2*b* do not overlap in the widthwise direction. Accordingly, an image can be printed on wide paper 99. In a line printer type ink jet head, the longer the ink jet head, the worse the yield. In the ink jet printer 100 of the present embodiment, relatively short ink jet heads 1, 2 are used so that an image can be printed on wide paper 99 equivalent to JIS-A4 size paper (portrait orientation). Therefore, the yield of the ink jet heads can be further improved and the production costs can be further reduced.

There is a relatively small number of requests for printing an image on wide paper 99 at high resolution. High-resolution color printing is performed mainly on small paper 99 such as photo type paper. In the ink jet printer 100 of the present embodiment, the ink jet head 1 is moved as described above, whereby the operation of printing an image on the relatively large sheet of paper 99 at normal resolution (e.g., 600 dpi) and the operation of printing an image on the relatively small paper 99 at high resolution (e.g., 1200 dpi) can be selectively executed.

Furthermore, the ink jet head 1 is moved by rotating the screw shaft 11, thus the ink jet head 1 can be accurately disposed at the abovementioned high quality printing position or the abovementioned low quality printing position. Also, the configuration of the movement mechanism of the ink jet head 1 can be simplified by using the screw shaft 11.

Figure 6A:
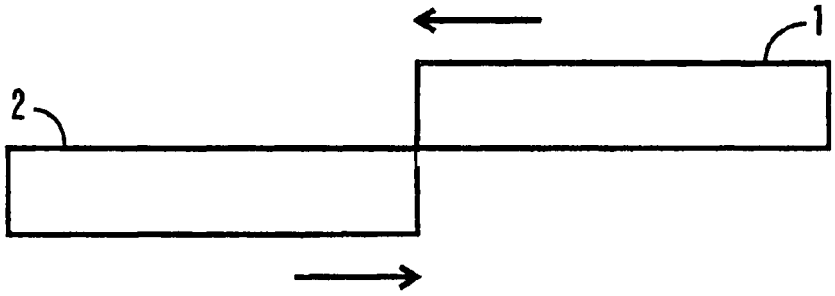
FIG. 6A schematically shows the configuration of a variant of the ink jet printer.

In the above-described embodiment, the ink jet head 2 is fixed, while the ink jet head I is moved. However, the ink jet head 1 may be fixed, and the ink jet head 2 may be moved. As schematically shown in FIG. 6A, both the ink jet head 1 and the ink jet head 2 may be moved. This movement mechanism is not limited to the above embodiment where the screw shaft 11 is used. For example, a mechanism using a spur gear and a rack may be used. Also, for example, a mechanism using an air cylinder, solenoid or the like may be adopted.

Figure 6B:
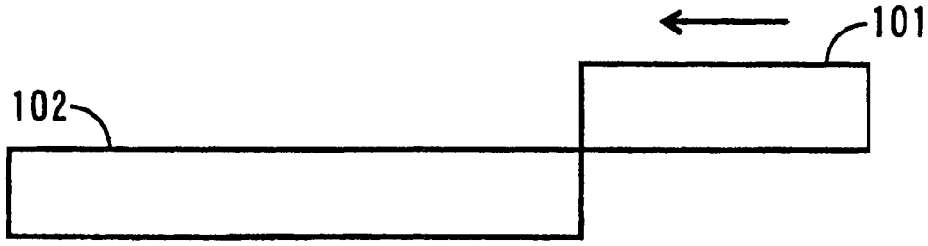
FIG. 6B schematically shows the configuration of a variant of the ink jet printer.

In the above-described embodiment, the ink jet heads 1, 2 have the same configuration as each other. However, as schematically shown in FIG. 6B, for example, the length of an ink jet head 101 may be configured so that it has a shorter length than the length of an ink jet head 102. In this case as well, a high-quality image can be printed at high resolution in the section where the ink jet heads 101, 102 overlap with each other along the widthwise direction. In this case, the lengths of the ink jet heads 101, 102 are appropriately set, and the shorter ink jet head 101 is moved so that the ink jet heads 101, 102 can overlap with each other at substantially the center of the maximum span of the ink jet heads 101, 102 across the widthwise direction. In this case, the embodiment is suitable to a so-called center-registration type ink jet printer in which the pair of guides provided on a paper tray move symmetrically toward the center in the widthwise direction. Moreover, when a shorter ink jet head 101 is moved, less energy is required for moving the ink jet head 101, thus the movement mechanism thereof can be simplified and production costs can be reduced.

Figure 7A:
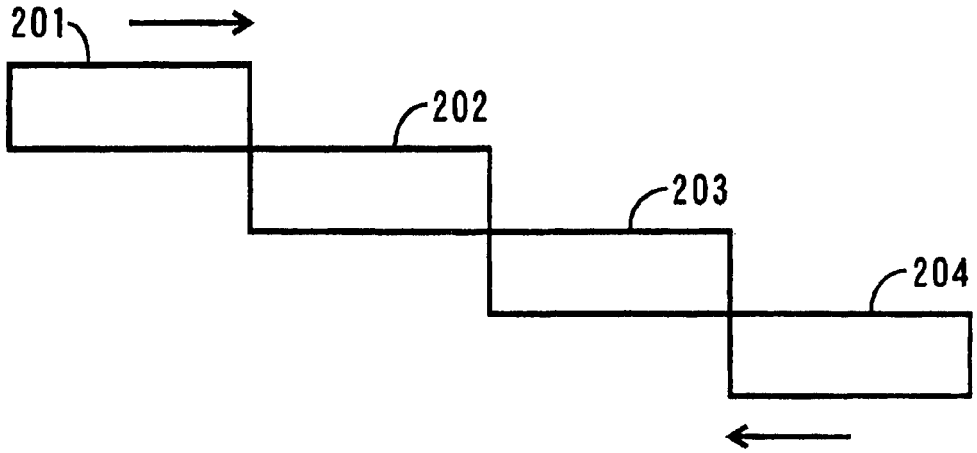
FIG. 7A schematically shows the configuration of a variant of the ink jet printer.

Furthermore, in the above-described embodiment, two ink jet heads 1, 2 (or 101, 102) are used. However, three or more ink jet heads may be used. For example, as schematically shown in FIG. 7A, four ink jet heads 201, 202, 203 and 204 may be used. In this case, each of the ink jet heads 201, 202, 203 and 204 may be offset in the paper-transporting direction. In this case, the ink jet heads 201 and 204 at both ends may be moved. The lengths of each of the ink jet heads 201 through 204 can be further reduced. As a result, the yield obtained when producing the ink jet heads can be improved.

Figure 7B:
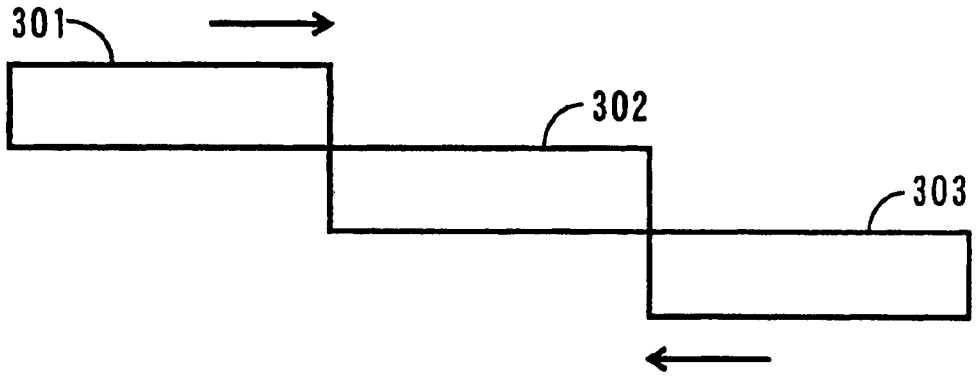
FIG. 7B schematically shows the configuration of a variant of the ink jet printer.

As schematically shown in FIG. 7B, three ink jet heads 301, 302 and 303 that have the same configuration as one another may be used. In this case, the three ink jet heads 301, 302 and 303 may overlap in the widthwise direction. In this case, the resolution can be tripled.

Figure 8:
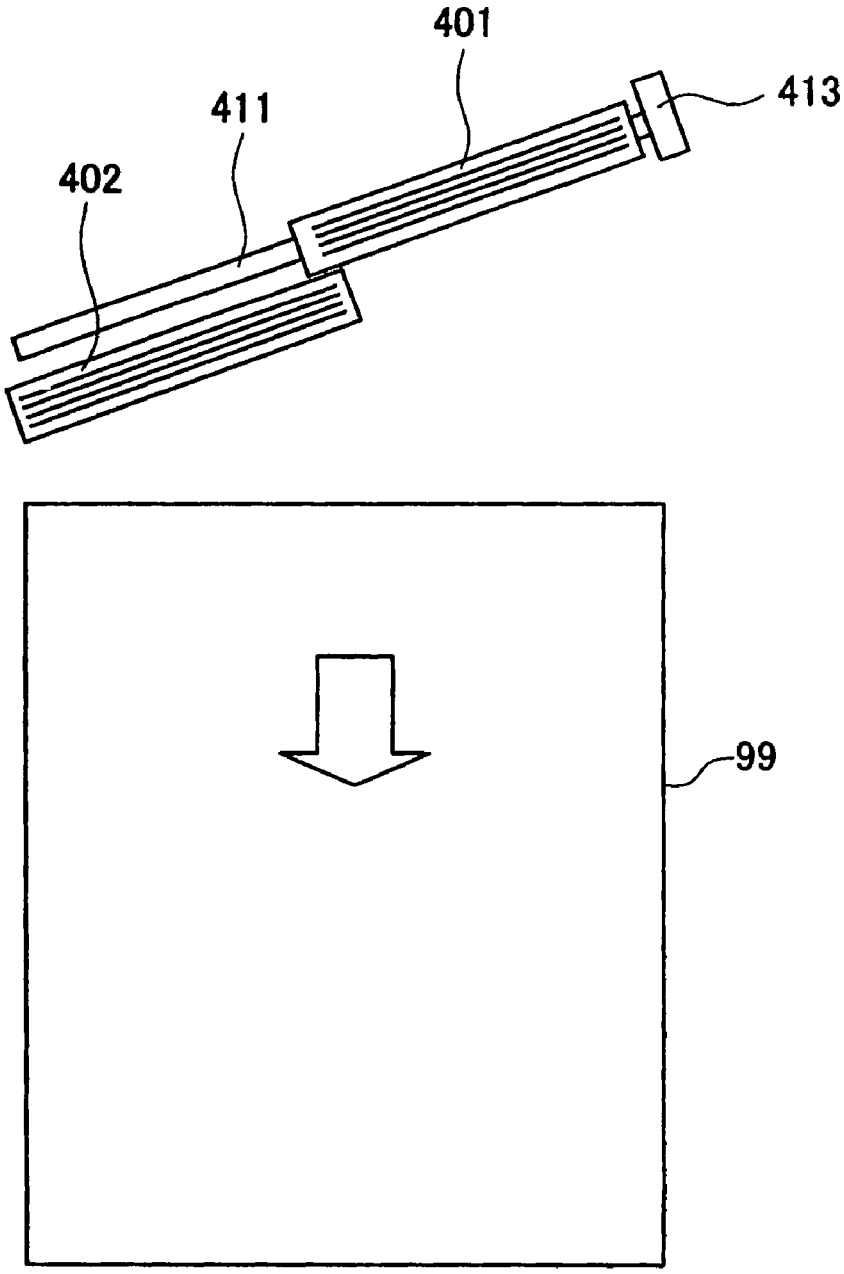
FIG. 8 schematically shows the configuration of a variant of the ink jet printer.

As described above, the technology of the present embodiment can also be applied to a printer in which ink jet heads 401 and 402 are disposed on a tilt, as shown in FIG. 8.

The ink jet heads 401, 402 are tilted with respect to an axis perpendicular to the printing surface of the paper 99 as a center. A screw shaft 411 is engaged with the ink jet head 401 along the longitudinal direction. The chassis of the ink jet printer (not shown) is provided with a head moving motor 413 that rotates the screw shaft 411 to move the ink jet head 401. The ink jet head 401 can move in the longitudinal direction thereof by rotating the head moving motor 413.

In the state shown in FIG. 8, the ink jet heads 401, 402 are disposed in the low quality printing position. In order to dispose the ink jet heads 401, 402 in the high quality printing position, the ink jet head 401 is moved in the longitudinal direction by means of the head moving motor 413. The state in which the ink jet head 401 overlaps with the ink jet head 402 along a direction perpendicular to the paper-transporting direction is the same as a state in which the ink jet heads 401, 402 are disposed in the high quality printing position.

Specific examples of the present invention are described above in detail, but these examples are merely illustrative and place no limitation on the scope of the patent claims. The technology described in the patent claims also encompasses various changes and modifications to the specific examples described above.

Furthermore, the technical elements explained in the present specification and drawings provide technical value and utility either independently or through various combinations. The present invention is not limited to the combinations described at the time the claims are filed. In addition, the purpose of the examples illustrated by the present specification and drawings is to satisfy multiple objectives simultaneously, and satisfying any one of those objectives gives technical value and utility to the present invention.

What is claimed is:

1. An ink jet printer, comprising:

a transportation device that transports a print medium along a first direction within a predetermined plane;

a first ink jet head having a first nozzle line, wherein the first nozzle line has a plurality of nozzles for discharging ink, and the nozzles of the first nozzle line are aligned along a direction which intersects with the first direction within the predetermined plane;

a second ink jet head having a second nozzle line, wherein the second nozzle line has a plurality of nozzles for discharging ink, and the nozzles of the second nozzle line are aligned along a direction which intersects with the first direction within the predetermined plane; and a head moving device that moves the first ink jet head with respect to the second ink jet head along a direction which intersects with the first direction within the predetermined plane, between a first positional relationship and a second positional relationship, wherein in the first positional relationship, the first nozzle line and the second nozzle line overlap each other along a second direction which is perpendicular to the first direction within the predetermined plane, and each of the nozzles of the first nozzle line and of the second nozzle line are mutually offset along the second direction, and in the second positional relationship, the first nozzle line and the second nozzle line do not overlap along the second direction, in contrast to the first positional relationship.

2. The ink jet printer as in claim 1, wherein in the second positional relationship, the first nozzle line and the second nozzle line do not overlap each other along the second direction.

3. The ink jet printer as in claim 1, wherein the nozzles of the first nozzle line are aligned along the second direction within the predetermined plane.

4. The ink jet printer as in claim 1, wherein the nozzles of the second nozzle line are aligned along the second direction within the predetermined plane.

5. The ink jet printer as in claim 1, wherein the head moving device moves the first ink jet head with respect to the second ink jet head along the second direction.

6. The ink jet printer as in claim 1, wherein the first ink jet head is offset from the second ink jet head along the first direction.

7. The ink jet printer as in claim 6, wherein the first ink jet head and the second ink jet head are located at the same height.

8. The ink jet printer as in claim 1, wherein the first ink jet head has an elongated shape along the second direction, and the second ink jet head has an elongated shape along the second direction.

9. The ink jet printer as in claim 1, wherein a length of the first ink jet head along the second direction is equal to a length of the second ink jet head along the second direction.

10. The ink jet printer as in claim 1, wherein the head moving device moves either one of the first ink jet head and the second ink jet head along the direction which intersects with the first direction within the predetermined plane and does not move the other ink jet head.

11. The ink jet printer as in claim 1, wherein the head moving device has a screw engaged with the first ink jet head, and an actuator that rotates the screw in order to move the first ink jet head with respect to the second ink jet head along the direction which intersects with the first direction within the predetermined plane.

12. The ink jet printer as in claim 1, wherein the nozzles of the first nozzle line are aligned along the second direction with a predetermined uniform gap therebetween, and the nozzles of the second nozzle line are aligned along the second direction with the predetermined uniform gap therebetween.

13. The ink jet printer as in claim 12, wherein in the first positional relationship, the nozzles of the first nozzle line and of the second nozzle line are alternately aligned along the second direction.

14. The ink jet printer as in claim 1, wherein a nozzle pattern of the first ink jet head is identical to a nozzle pattern of the second ink jet head.

* * * * *